United States Patent [19]

Moraly

[11] 4,252,472

[45] Feb. 24, 1981

[54] FIXING POSTS IN THE GROUND

[76] Inventor: Paul Moraly, 168, 170 avenue Victor Hugo, 93110 Rosny Sous Bois, France

[21] Appl. No.: 28,749

[22] Filed: Apr. 10, 1979

[30] Foreign Application Priority Data

Apr. 10, 1978 [FR] France ..... 78 11279

[51] Int. Cl.[3] ..... E02D 5/80; E04H 17/22; E04H 17/26

[52] U.S. Cl. ..... 405/244; 52/154; 52/165; 173/126

[58] Field of Search ..... 405/244; 173/126, 132; 52/165, 153, 154, 155, 157

[56] References Cited

U.S. PATENT DOCUMENTS

| | | | |
|---|---|---|---|
| 891,448 | 6/1908 | Snider | 52/157 |
| 2,086,213 | 7/1937 | Collord | 405/244 |
| 2,282,049 | 5/1942 | Haggart, Jr. | 405/244 |
| 3,066,769 | 12/1962 | Pasquale | 52/165 X |
| 3,132,726 | 5/1964 | Johnson | 52/153 |
| 3,342,444 | 9/1967 | Nelson | 52/165 |
| 3,696,873 | 10/1972 | Anderson | 173/126 X |
| 3,783,953 | 1/1974 | Kopaska | 173/126 X |
| 3,896,596 | 7/1975 | Berger | 52/153 |
| 3,969,853 | 7/1976 | Deike | 52/165 X |

*Primary Examiner*—Stephen J. Novosad
*Attorney, Agent, or Firm*—William A. Drucker

[57] ABSTRACT

A peg device for the fixing of posts and stakes in the ground has a rigid member shaped to permit it to be readily driven into the ground and defining a housing which can receive a base portion of the post or stake. A preferred construction has a number of metal plates forming the rigid member, each plate including a bent up edge portion welded to another of the plates, the assembly of plates being positioned so as to define a central sheath bounding the housing. The rigid member may be shaped to permit it to be screwed into the ground. For driving the peg device into the ground, a driving device may be inserted in the housing and pressure exerted on the driving device, for example by repeated operation of a ram which is slidable up and down a rod portion to abut on a stop.

12 Claims, 10 Drawing Figures

FIXING POSTS IN THE GROUND

BACKGROUND OF THE INVENTION

This invention relates to the fixing in the ground of posts or stakes and more particularly but not exclusively for the construction of fencing.

Fencing posts made of iron or of concrete are conventionally put in place in the center of a hole and then pushed slightly into the ground to make them keep upright, and then surrounded by a block of poured concrete which is rammed down until its surface is slightly below the level of the ground. When the concrete has set, the hole is levelled up with more earth. These various operations take a relatively long time, and particularly the setting of the concrete. The production of concrete requires the use of water, which is not always available on the site, and of heavy materials which it is often necessary to transport from some distance away with a wheelbarrow, on a terrain the shape of which sometimes makes this transportation very difficult. The soil resulting from the excavation must be dispersed on the ground. If the site is sewn with grass it will obviously be damaged.

OBJECT OF THE INVENTION

It is the object of this invention to provide a method and means whereby these inconveniences may be avoided and which permits the simple and rapid setting up of posts or stakes of any size by the use of a peg device.

SUMMARY OF THE INVENTION

According to the present invention this peg device comprises a rigid element made in such a manner as to permit it to be driven into the ground to form an anchor and to act as a housing to receive the base of the post or stake.

In accordance with a particularly simple manner of construction the said element is formed of two metal plates each comprising a bent up edge welded to the other plate in such a manner as to bound a central sheath which constitutes the said housing.

The invention also provides a method for the setting up of a post or stake by making use of such a peg device and a driving and guiding tool serving for carrying out the method.

Other features and advantages of the invention will be clearly apparent from the following description.

DESCRIPTION OF THE PREFERRED EMBODIMENTS

Figure 1:
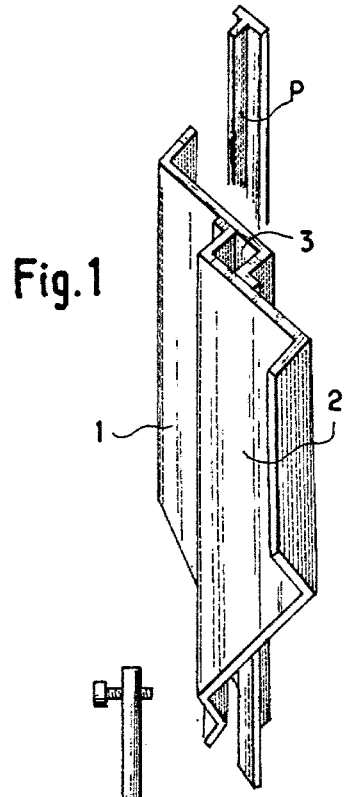
FIGS. 1 to 3 show, respectively in perspective, in plan, and in profile, a peg device in accordance with a preferred embodiment of the invention.
Figure 3:
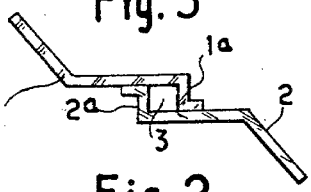
Figure 2:
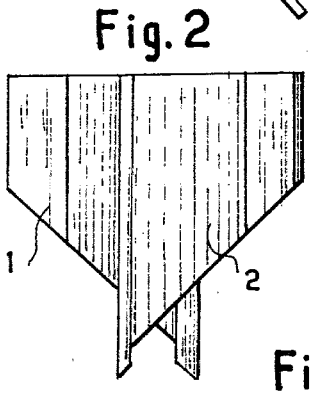

In FIGS. 1 to 3 there are shown two parallel metal plates 1 and 2 each provided with an edge portion 12 and 22 respectively bent up twice at a right angle. Each bent up edge portion is welded on the surface of the other plate, and the arrangement is such that the plates bound a central parallelpipedal space 3. This space constitutes a sheath the dimensions of which are slightly greater than the external sides of the section of a post P to be set up. It can be seen moreover that the lower edge of each plate has a cut off corner which has the effect of pushing out of the way small and medium sized stones during the driving in operation, and thus facilitates the same.

By way of example, for a post made of a T-section iron member measuring 40×40 mm., it would be possible to use a peg device 50 cm. in height and lying within a circle 50 cm. in diameter, and forming a sheath with a 41 mm. side.

Figure 4:
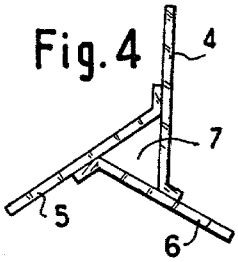
FIGS. 4 to 7 show variations of construction, seen in profile.
Figure 5:
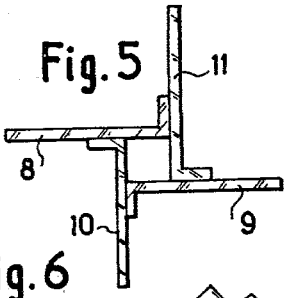

FIG. 4 shows a variation of construction with three plates 4,5 and 6 forming a sheath 7 of triangular section. In the variation with four plates arranged in a cross, shown in FIG. 5, the plates 8 and 9 are parallel to each other and are perpendicular to the plates 10 and 11.

Figure 6:
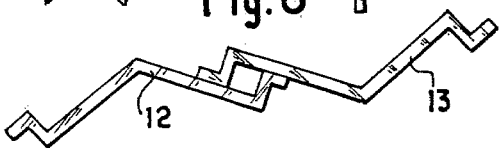

The variation of FIG. 6 differs from the manner of construction of FIGS. 1 to 3 only by the fact that the external edge portions of the two plates 12–13 are bent up twice, like the internal edge portions. This shape facilitates cutting out without wastage from a strip of metal. It will be noted that the shovel-like shape of the constructions of FIGS. 1 to 3 and 6 result in a particularly economical manufacture which is very rigid during the driving in operation and which is easy to stack.

Figure 7:
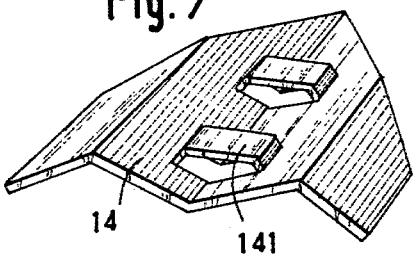

In the variation of FIG. 7, an element 14 having a "W" profile is pressed out at 14[1] in order to form two vertical housings; in a variation, these housings could be obtained by means of parts added on.

Figure 8:
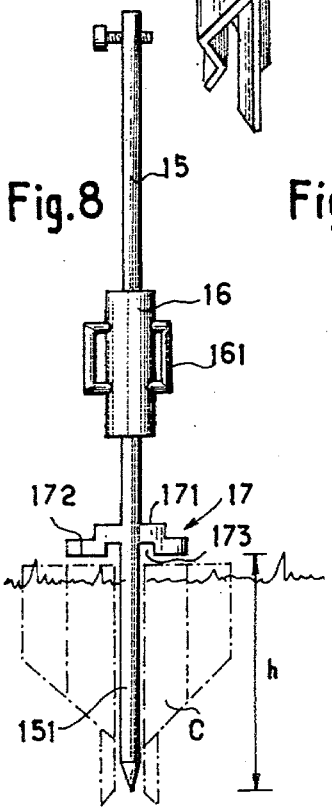
FIG. 8 shows a manual tool for driving in the peg device.

FIG. 8 illustrates the operation of driving in. In a first stage the peg device C, shown very schematically, is rested on the ground. In a second stage, a dummy stake 15 is introduced into the sheath of the peg device for a length slightly greater than the height h of the peg device in such a manner as to enter slightly into the ground. In a third stage, blows are transmitted to the peg device with the aid of a metal sleeve 16 which slides on the rod 15 and the base of which strikes on a ring 17 fast to the rod 15; When the peg device has been driven completely into the ground (the position shown in chain-dotted lines) the dummy stake is withdrawn and the post is inserted in the sheath.

The post is kept in place by the wires of the enclosure or by a light setting operation at the top of the sheath and by reason of the penetration of its base into the ground below the peg device. The ground remains intact and clean.

The sleeve 16 is provided with handles 161 which permit its operation by hand. The ring 17 has an upper surface 171 which receives the blows of the sleeve 16, and a lower surface having a peripheral portion 172 which bears on the peg device, and a central hollow portion 173. The portion 172 preserves the peg device from being crushed, whilst the hollow part 173 preserves the sheath of the peg device from undergoing any upsetting action which would prevent the subsequent positioning therein of the post or stake. The bottom part 151 of the rod 15, by being introduced into the said sheath, prevents the earth from entering therein and facilitates guiding of the peg device.

Figure 9:
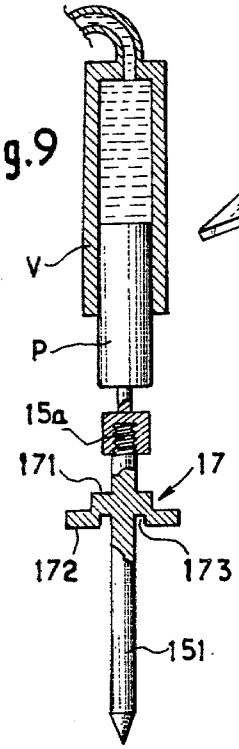
FIG. 9 shows a tool for carrying out this operation in cooperation with a hydraulic ram or similar means.
Figure 10:
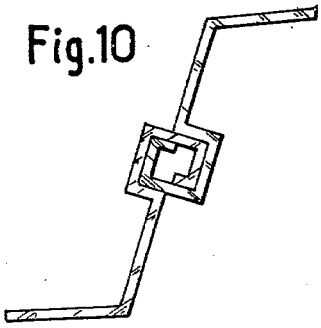
FIG. 10 shows a variation having two pieces which are not welded but which, fitted one in the other, form the complete peg device.

In the variation of FIG. 9, the upper part of the rod of the dummy stake is cut off short and is not provided with a driving in sleeve. It has simply a head 15[a] for the engagement of a piston p of a hydraulic ram V, or any other mechanical driving means.

It is to be understood that the peg devices which have been described can be manufactured suitably to receive posts or stakes of any dimensions, cross-section and nature, and can comprise plates or wings different in number or of different shapes. If the peg devices are intended to penetrate into a very hard soil, it would even be possible to replace the wings by an element having a shape which was more appropriate for penetration, for example helicoidal, on condition of course that this element forms a sheath which is open at least at one extremity. The driving in operation would then be able to take place by introducing into the sheath a key permitting the peg device to be screwed into the ground.

I claim:

1. A peg device, for fixing posts and stakes in the ground, comprising a rigid member shaped for driving into the ground to form an anchor, said rigid member including a housing adapted to receive a base portion of said post of stake, wherein said rigid member comprises a plurality of metal plates in number between two and four inclusive, said metal plates each including a bent up edge portion which is welded to another of said plates, said plates being positioned with respect to each other so as to provide a central sheath bounding said housing.

2. A peg device as claimed in claim 1 and essentially consisting of two metal plates each forming a single wing of the peg device, the edge portions of the respective plates being twice folded at right angles and being shifted one with respect to the other so as to provide the said central sheath.

3. A peg device as claimed in claim 1, wherein said sheath is open at both ends and has a length which substantially corresponds to the whole length of the peg device.

4. A peg device, for fixing posts and stakes in the ground, comprising a rigid member shaped for driving into the ground to form an anchor, said rigid member including a housing adapted to receive a base portion of said post or stake, wherein said rigid member comprises two metal plates, said metal plates each including a bent up edge portion which is fitted in the bent up edge portion of the other plate, said interfitting bent up edge portions being positioned with respect to each other so as to provide a central sheath bounding said housing.

5. A peg device as claimed in claim 4, wherein each of said metal plates forms a single wing of the peg device, the edge portions of the respective plates being twice folded at right angles and being shifted one with respect to the other so as to provide the said central sheath.

6. A peg device as claimed in claim 4, wherein said sheath is open at both ends and has a length which substantially corresponds to the whole length of the peg device.

7. A method for setting up posts and stakes in the ground, utilising a peg device comprising a rigid member shaped for driving into the ground to form an anchor, said rigid member including a housing adapted to receive a base portion of said post or stake, said rigid member comprising a plurality of metal plates in number between two and four inclusive, said metal plates each including a bent up edge portion which is welded to another of said plates, said plates being positioned with respect to each other so as to provide a central sheath bounding said housing, said method comprising the steps of:

(i) standing said peg device on the ground, (ii) introducing a driving and guiding tool into said housing of said peg device, said tool comprising: a massive rod adapted for insertion in and through said housing of said rigid member of said peg device, and a stop member provided on said rod at a distance from the bottom end of said rod which is at least equal to the height of said rigid member, said stop member having a lower surface of which a peripheral part is positioned to abut on said rigid member, and of which a central part is hollow, (iii) exerting pressure through said driving and guiding tool to force said peg device into the ground, and (iv) removing said tool from said housing and introducing the post in said housing.

8. The method claimed in claim 7, wherein said step (iii) of exerting pressure through said driving and guiding tool is carried out by sliding a sleeve portion of said tool on a rod portion of said tool for repeated ramming of said rod portion.

9. A method for setting up posts and stakes in the ground, utilising a peg device comprising a rigid member shaped for driving into the ground to form an anchor, said rigid member including a housing adapted to receive a base portion of said post or stake, said rigid member comprising two metal plates, said metal plates each including a bent up edge portion which is fitted in the bent up edge portion of the other plate, said interfitting bent up edge portions being positioned with respect to each other so as to provide a central sheath bounding said housing, said method comprising the steps of:

(i) standing said peg device on the ground, (ii) introducing a driving and guiding tool into said housing of said peg device, (iii) exerting pressure through said driving and guiding tool to force said peg device into the ground, and (iv) removing said tool from said housing and introducing the post in said housing, said tool comprising: a massive rod adapted for insertion in and through said housing of said rigid member of said peg device, and a stop member provided on said rod at a distance from the bottom end of said rod which is at least equal to the height of said rigid member, said stop member having a lower surface of which a peripheral part is positioned to abut on said rigid member, and of which a central part is hollow.

10. The method claimed in claim 9, wherein said step (iii) of exerting pressure through said driving and guiding tool is carried out by sliding a sleeve portion of said tool on a rod portion of said tool for repeated ramming of said rod portion.

11. A driving and guiding tool, for use in carrying out a method for setting up posts and stakes in the ground, utilising a peg device comprising a rigid member shaped for driving into the ground to form an anchor, said rigid member including a housing adapted to receive a base portion of said post or stake, said rigid member comprising a plurality of metal plates in number between two and four inclusive, said metal plates each including a bent up edge portion which is welded to another of said plates, said plates being positioned with respect to each other so as to provide a central sheath bounding said housing, said method comprising the steps of:

(i) standing said peg device on the ground, (ii) introducing a driving and guiding tool into said housing of said peg device, (iii) exerting pressure through said driving and guiding tool to force said peg device into the ground, (iv) removing said tool from said housing and introducing the post in said housing, said tool comprising: a massive rod adapted for insertion in and through said housing of said rigid member of said peg device, and a stop member provided on said rod at a distance from the bottom end of said rod which is at least equal to the height of said rigid member, said stop member having a lower surface of which a peripheral part is positioned to abut on said rigid member, and of which a central part is hollow.

12. A driving and guiding tool, for use in carrying out a method for setting up posts and stakes in the ground, utilising a peg device comprising a rigid member shaped for driving into the ground to form an anchor, said rigid member including a housing adapted to receive a base portion of said post or stake, said rigid member comprising two metal plates, said metal plates each including a bent up edge portion which is fitted in the bent up edge portion of the other plate, said interfitting bent up edge portions being positioned with respect to each other so as to provide a central sheath bounding said housing, said method comprising the steps of:

(i) standing said peg device on the ground, (ii) introducing a driving and guiding tool into said housing of said peg device, (iii) exerting pressure through said driving and guiding tool to force said peg device into the ground, and (iv) removing said tool from said housing and introducing the post in said housing, said tool comprising: a massive rod adapted for insertion in and through said housing of said rigid member of said peg device, and a stop member provided on said rod at a distance from the bottom end of said rod which is at least equal to the height of said rigid member, said stop member having a lower surface of which a peripheral part is positioned to abut on said rigid member, and of which a central part is hollow.

* * * * *